US009986859B2

(12) United States Patent
Hynes

(10) Patent No.: US 9,986,859 B2
(45) Date of Patent: Jun. 5, 2018

(54) ROTATABLE AND STABLE CONTAINER

(71) Applicant: Vinotemp International Corporation, Irvine, CA (US)

(72) Inventor: India Hynes, Laguna Beach, CA (US)

(73) Assignee: VINOTEMP INTERNATIONAL CORPORATION, Irvine, CA (US)

( * ) Notice: Subject to any disclaimer, the term of this patent is extended or adjusted under 35 U.S.C. 154(b) by 134 days.

(21) Appl. No.: 15/222,812

(22) Filed: Jul. 28, 2016

(65) Prior Publication Data

US 2017/0027348 A1 Feb. 2, 2017

Related U.S. Application Data

(60) Provisional application No. 62/198,028, filed on Jul. 28, 2015.

(51) Int. Cl.

| | |
|---|---|
| ***B65D 1/02*** | (2006.01) |
| ***A47G 19/22*** | (2006.01) |
| ***B01F 3/04*** | (2006.01) |
| ***B65D 23/00*** | (2006.01) |

(52) U.S. Cl.

CPC ..... *A47G 19/2205* (2013.01); *A47G 19/2261* (2013.01); *B01F 3/04794* (2013.01); *B65D 1/02* (2013.01); *B65D 23/00* (2013.01); *A47G 2400/045* (2013.01); *B01F 2003/04865* (2013.01)

(58) Field of Classification Search

CPC ..... B65D 1/02; B65D 23/00; B01F 3/04
USPC ..... 215/370, 371, 382
See application file for complete search history.

(56) References Cited

U.S. PATENT DOCUMENTS

| | | | | |
|---|---|---|---|---|
| 3,341,184 A | | 9/1967 | Merrill | |
| 5,873,477 A | * | 2/1999 | Jago | B65D 1/0276 215/372 |
| 2013/0037680 A1 | | 2/2013 | Bushkovskiy | |

* cited by examiner

*Primary Examiner* — Robert A Hopkins
(74) *Attorney, Agent, or Firm* — Knobbe, Martens, Olson & Bear, LLP

(57) ABSTRACT

Aspects of the present invention comprise a container that is stably rotatable. In embodiments, a container may rotate about a central axis, wherein the container comprises at least one feature at the central axis that facilitate rotation and at least one other lateral feature that provides stability to the container to reduce the occurrence of tipping or spilling while the container is moving.

18 Claims, 18 Drawing Sheets

600

1100

1200

1300

1500

ROTATABLE AND STABLE CONTAINER

INCORPORATION BY REFERENCE TO ANY PRIORITY APPLICATIONS

Any and all applications for which a foreign or domestic priority claim is identified in the Application Data Sheet as filed with the present application are hereby incorporated by reference herein and made a part of the present disclosure.

BACKGROUND

Field

The present disclosure relates to containers and, more particularly, to containers that are rotatable or spinnable without tipping that would cause the container's contents to spill.

Description of Related Art

Beverage containers currently exist that have uneven bases. Such containers can be made to wobble. However, the range of velocity that such containers can experience is quite limited because too much movement, too much speed, or both will cause these beverage containers to spill their contents. Others have attempted to mitigate the spilling problem with caps, braces, and heavier materials. However, these approaches do not provide an easily rotatable, elegant, and versatile container that is resistant to tipping or spilling.

Accordingly, what is needed are containers that can be rotated without concern for tipping or excessive wobbling of the container that may cause the contents of the container to spill or that at least provide the public with a useful choice.

SUMMARY OF THE INVENTION

In some configurations, a glass configured for stable spinning includes a base and a container wall extending upwardly from the base. The base and the container wall cooperate to define a central axis and a receptacle for receiving a liquid. A bottom surface of the base comprises a central axis feature positioned about a central axis of the glass and a lateral feature positioned proximate an outer edge of the bottom surface of the base a radial distance from the central axis. The lateral feature encircles the base. The central axis feature extends below a plane defined by the lateral feature by an offset distance such that the glass rests on the central axis feature when placed on a flat surface and the lateral feature contacts the flat surface when the glass is tilted. The offset distance is between 0.05 mm and 0.15 mm and a ratio of the radial distance to the lateral feature to the offset distance is between 200:1 and 1000:1.

In some configurations, an interior surface of the container wall comprises at least one aeration feature that extends in a circumferential direction of the container wall.

In some configurations, the at least one aeration feature comprises a first aeration feature and a second aeration feature.

In some configurations, a first plane defined by the first aeration feature is angled relative to a second plane defined by the second aeration feature.

In some configurations, both the first plane and the second plane are angled relative to an upper edge of the container wall.

In some configurations, the at least one aeration feature extends uninterrupted around the container wall.

In some configurations, the base is circular or polygonal in shape.

In some configurations, a glass configured for stable spinning includes a base and a container wall extending upwardly from the base. The base and the container wall cooperate to define a central axis and a receptacle for receiving a liquid. A bottom surface of the base comprises a central axis feature positioned about a central axis of the glass and a lateral feature positioned proximate an outer edge of the bottom surface of the base a radial distance from the central axis. The lateral feature encircles the base. The central axis feature extends below a plane defined by the lateral feature by an offset distance such that the glass rests on the central axis feature when placed on a flat surface and the lateral feature contacts the flat surface when the glass is tilted. A portion of the central axis feature that intersects the plane of the lateral feature defines a projection diameter, wherein a ratio of a diameter of the lateral feature to the projection diameter is between 10:1 and 40:1.

In some configurations, an interior surface of the container wall comprises at least one aeration feature that extends in a circumferential direction of the container wall.

In some configurations, the at least one aeration feature comprises a first aeration feature and a second aeration feature.

In some configurations, a first plane defined by the first aeration feature is angled relative to a second plane defined by the second aeration feature.

In some configurations, both the first plane and the second plane are angled relative to an upper edge of the container wall.

In some configurations, the projection diameter is between 3 mm and 5 mm.

In some configurations, the base is circular or polygonal in shape.

BRIEF DESCRIPTION OF THE DRAWINGS

References will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments. It shall be noted that the figures may not be depicted to scale.

DETAILED DESCRIPTION

Figure 1B:
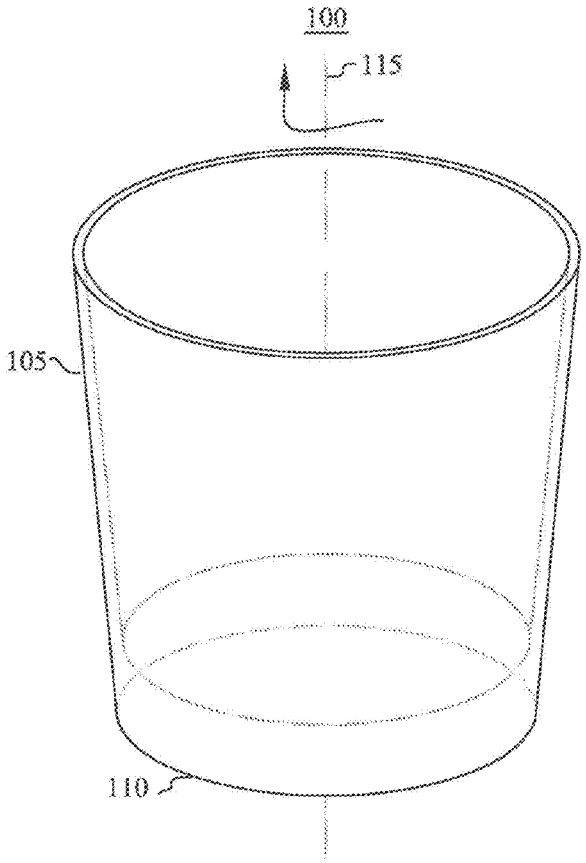
FIG. 1B depicts the base view of the container of FIG. 1A according to embodiments of the present invention.

In the following description, for purposes of explanation, specific details are set forth in order to provide an understanding of embodiments of the invention. It will be apparent, however, to one skilled in the art that the invention can be practiced without these details. Furthermore, one skilled in the art will recognize that embodiments of the present invention, described below, may be implemented in a variety of ways.

Reference in the specification to "one embodiment," "preferred embodiment," "an embodiment," or "embodiments" means that a particular feature, structure, characteristic or function described in connection with the embodiment is included in at least one embodiment and may be in more than one embodiment. Also, the appearances of the above noted phrases in various places in the specification are not necessarily all referring to the same embodiment or embodiments.

The use of certain terms in various places in the specification is for illustration and should not be construed as limiting. The terms "include," "including," "comprise," and "comprising" shall be understood to be open terms, and in any lists, the listed items are examples and are not meant to be limiting to only the listed items. Any headings used herein are for organizational purposes only and shall not be used to limit the scope of the description or the claims.

A. General Overview

Presented herein are embodiments of a container that does not topple, without excessive force, despite being designed to rotate about a central axis. In embodiments, the container may be made any material, including but not limited to plastic, glass, wood, metal, and the like, and may accommodate variety of payload in the receptacle of the container, including but not limited to liquids and solids.

In embodiments, prevention of tipping may be achieved by the container having a ratio of a base radius to its central axis height being within a range of approximately 1:2 to 1:5. In some embodiments, the value of ratio of distances between centers of the central axis feature and a lateral feature to the difference between their heights being within a range of approximately 50:1 to 1000:1, approximately 200:1 to 1000:1 or approximately 275:1. In some embodiments, the ratio of the base's lower surface area and a projection area of the central axis feature being within a range of approximately 200:1 to 800:1, approximately 400:1 to 750:1, or approximately 395:1. It shall be noted that, while the above-identified ratios work well m producing a container that is stable when rotated, one skilled in the art shall recognize that numerous other ratios may be used to similar effect. It shall also be noted that the central axis feature, lateral feature(s), and the container may be shaped in almost any way and constructed using almost any material.

B. Exemplary Embodiments

Presented herein are some embodiments provided by way of example only and not by way of limitation. One skilled in the art shall recognize other embodiments, which fall within the spirit and scope of the present patent document, may also be made.

Figure 1A:
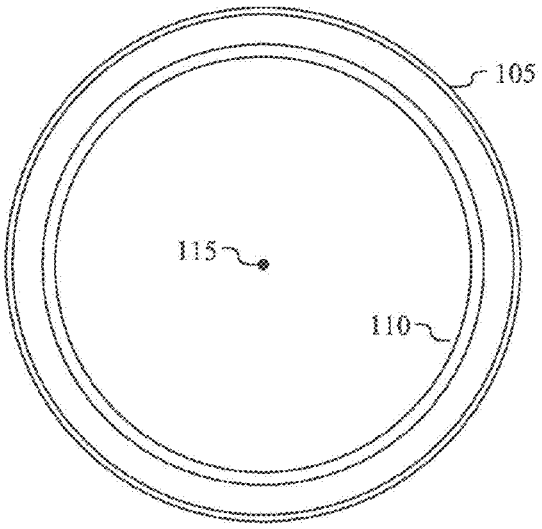
FIG. 1A depicts a perspective view of a container according to embodiments of the present invention.

FIG. 1A ("FIG. 1A") depicts a perspective view of a container according to embodiments of the present invention. FIG. 1B depicts the base view of the container of FIG. 1A according to embodiments of the present invention.

As shown in FIGS. 1A and 1B, the container 100 comprises a receptacle portion 105 for receiving a payload, such a liquid or solid, and a base 110. In embodiments, the container has a central axis 115 about which it can rotate.

Figure 2:
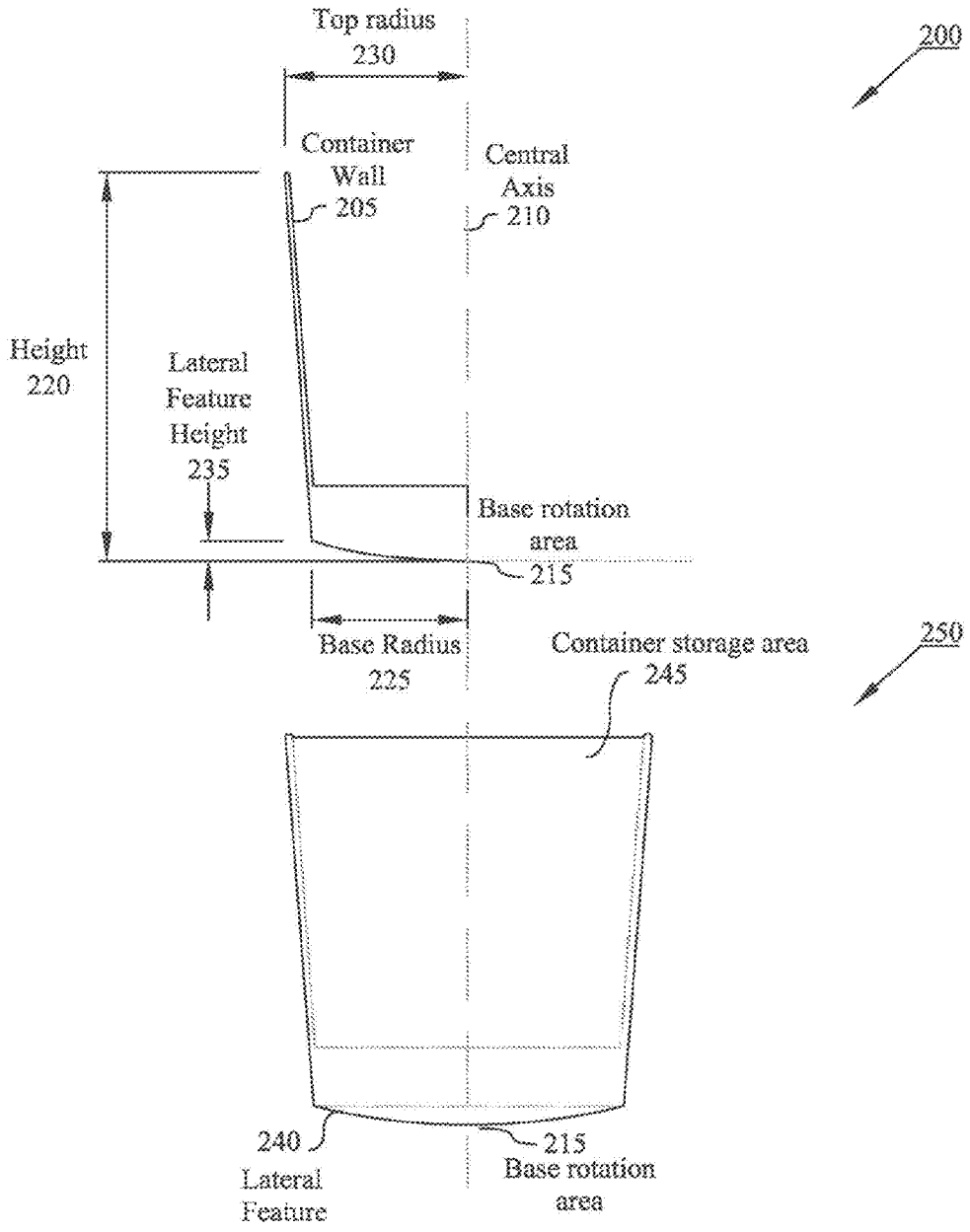
FIG. 2 depicts a section view and a side view of the container of FIG. 1A according to embodiments of the present invention.

Turning now to FIG. 2 depicts a section view 200 and a side view 250 of the container of FIG. 1A according to embodiments of the present invention. In embodiments, the rotational container comprises a central axis feature on the base (e.g., base rotation area 215) upon which the container 200 may easily rotate, and one or more lateral features 240 on the base to provide stability. As shown in the FIG. 2, the container 200 includes a hollowed portion, otherwise known as the container storage area 245 or receptacle, sits above and is attached to the base, which comprises the rotation feature 215 and the lateral feature 240. In embodiments, the central axis feature 215 is a center of balance for the container.

In embodiments, the container rotates about its central axis 210 on the base rotation feature 215 and is stabilized by the lateral features 240, as well as by the proportionality and structural quality of these features. In embodiments, the container's stability when rotating may be achieved by maintaining an appropriate ratio of the base's radius 225 to the central axis fixture's height 220 (e.g., a ratio around 1:2 to 1:5) and with a base possessing at least one lateral feature 240 of lesser height (e.g., height 235) than the central base rotation feature 215. It shall be noted that since the lateral feature extends around the base, in a cross-section of the container, it may be thought of as being two lateral features. However, it shall also be noted that there may be additional or different lateral features present at or near the base to provide stability. In such embodiments, the lateral features may be located at equal distances from the central axis feature 215 or may be at different distances.

In embodiments, the ratio of the surface area between the base rotation area 215 and the overall base (e.g., area calculated using the base radius 225) of the container may be around 1:25.

Furthermore, in embodiments, the height 235 of the central axis feature 215 in relation to the lateral feature 240 may be in the range of 0.05-0.15 mm when the base size (e.g., the base diameter) is within 20-100 mm.

In embodiments, good rotation is achieved when the container also has appropriately set base and lateral features for the container and an appropriate center of gravity when loaded. Such a container will rotate about the axis using the base rotational feature (e.g., feature 215) and using the lateral feature(s) (e.g., feature 240) for stability.

When a container processes these proportions, each of the central axis feature, the lateral feature or features, and the container structure groupings may be different shapes. Furthermore, when these proportions are present, the material or materials of the container may vary; however, the more uniform and solid the material, the more the proportions are likely to be maintained under load.

Figure 3A:
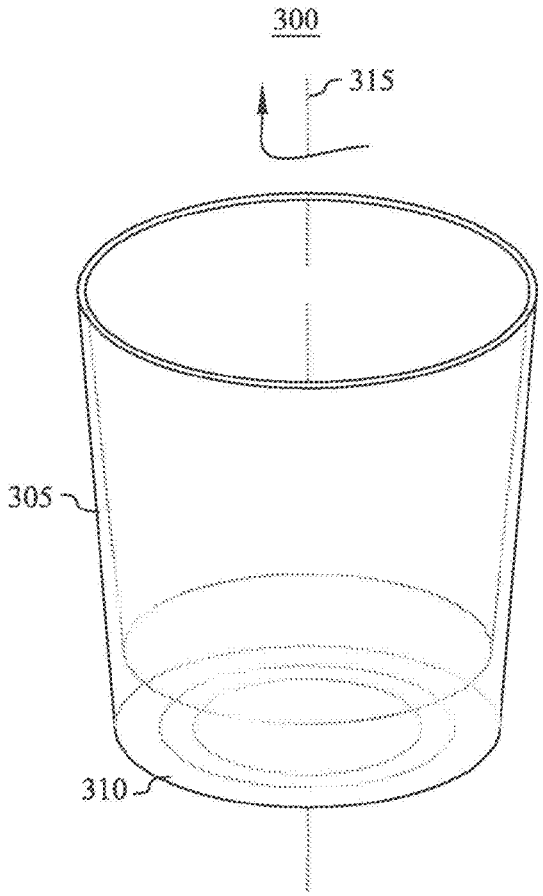
FIG. 3A depicts a perspective view of an alternative embodiment of a container according to embodiments of the present invention.
Figure 3B:
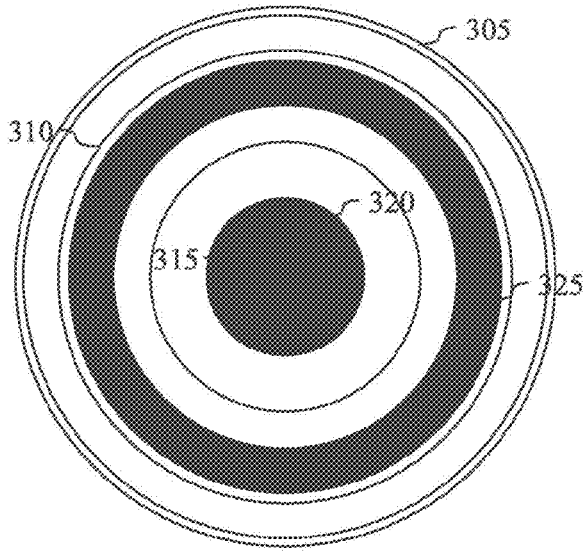
FIG. 3B depicts the base view of the container of FIG. 3A according to embodiments of the present invention.
Figure 4:
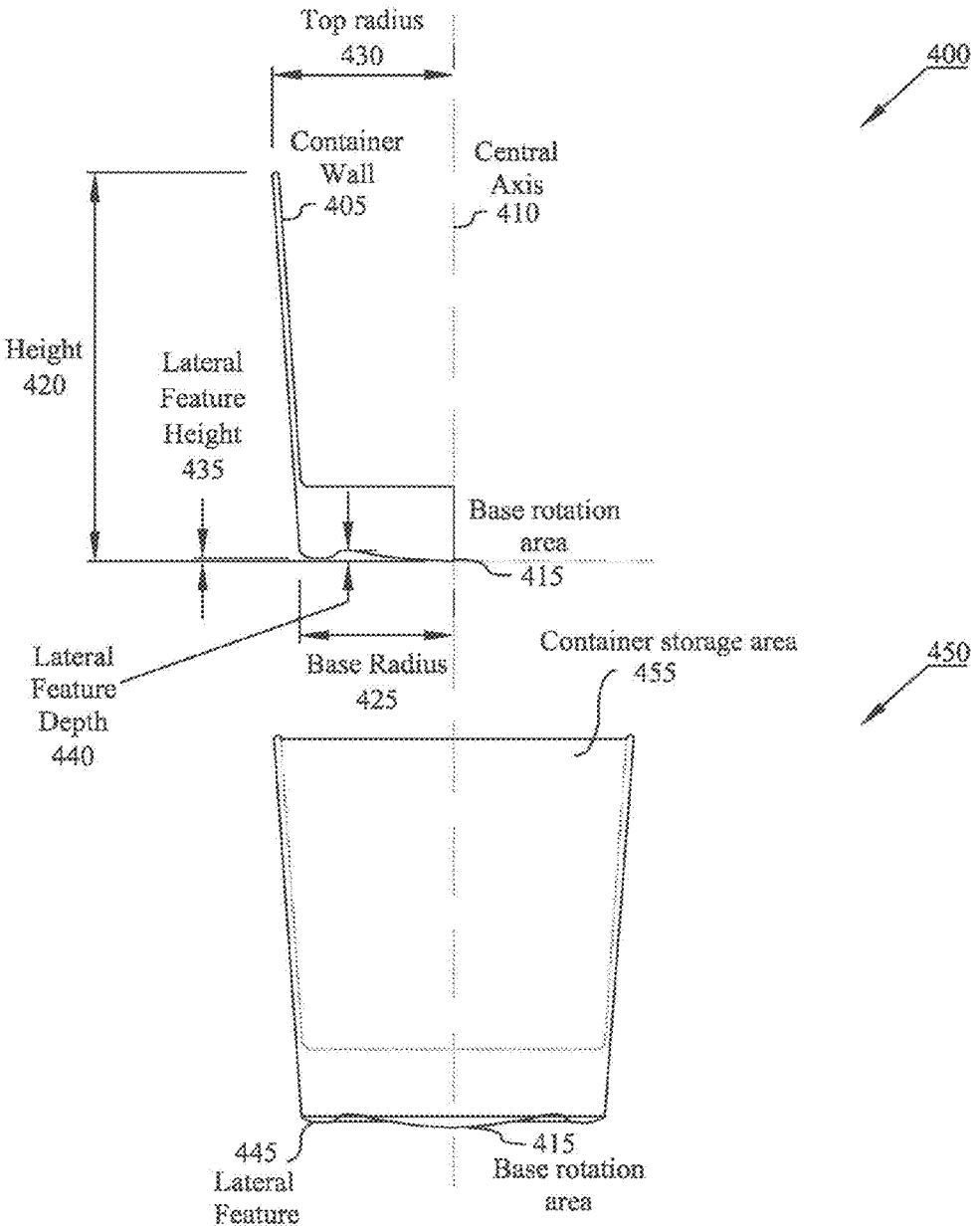
FIG. 4 depicts a section view and a side view of the container of FIG. 3A according to embodiments of the present invention.

Turning now to FIG. 3A and FIG. 3B, depicted is a perspective view and a base view, respectively, of an alternative embodiment of a container 300. As shown in FIGS. 3A and 3B, the container 300 comprises a central axis 315 about which it may rotate and a hollowed portion/container storage area 305 that sits above and is attached to a base 310. As illustrated in FIG. 4, the base 310 comprises the base rotation feature 415 and lateral features 445. Also illustrated in FIG. 3B is an approximation of the surface area 320 of the base feature 415 upon which the container rotates when on a supporting surface, and the surface area 325 of the lateral feature 445, part or all of which may, at times, also contact the supporting surface to provide stability.

FIG. 4 depicts a section view 400 and a side view 405 of the container of FIG. 3A according to embodiments of the present invention. As shown in FIG. 4, the lateral feature comprises a wave-like feature that extends from the base rotation area 415, moves upward to a maximum lateral feature depth 440, and then extends back downward to a height (i.e., the lateral feature height 435) that is still slightly above the base rotation area 415. This height difference (i.e., the lateral feature height 435) allows the container to easily rotate about the central rotation point 415 but still provides stability from the lateral feature. In embodiments, the container may possess the same or similar ratios as previously described.

Figure 5:
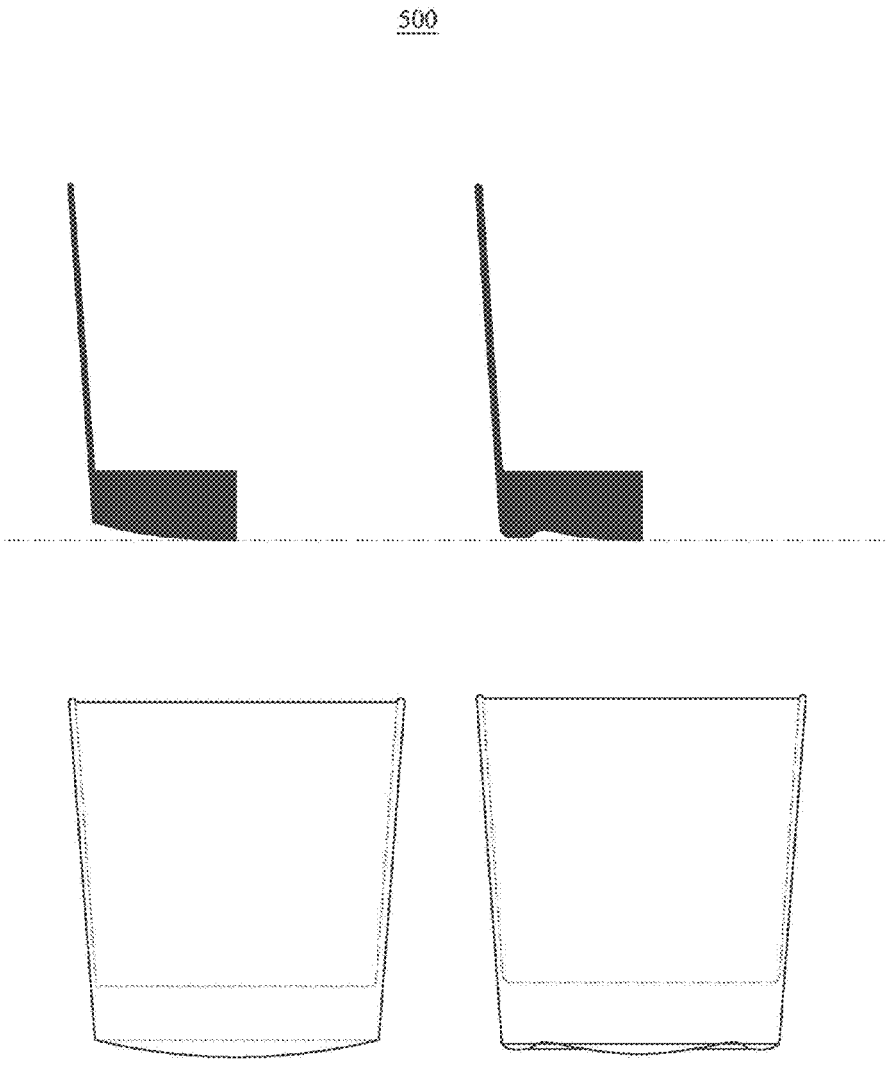
FIG. 5 depicts additional section views and side views of embodiments of containers according to embodiments of the present invention.

FIG. 5 depicts additional section views and side views of embodiments of containers 500 according to embodiments of the present invention.

Figure 6:
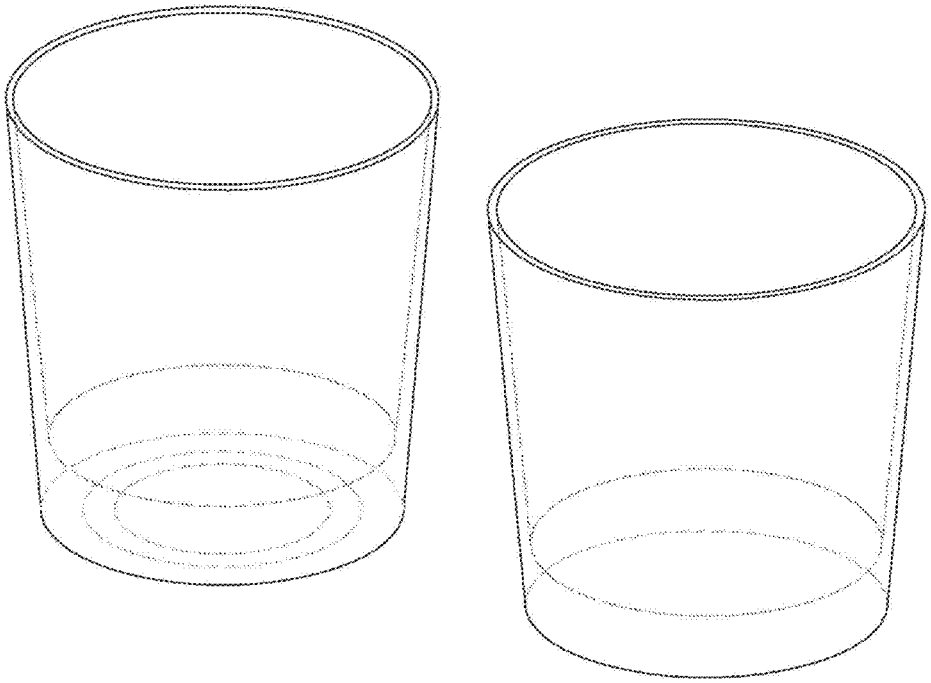
FIG. 6 depicts additional perspective views of alternative embodiments of containers according to embodiments of the present invention.

FIG. 6 depicts additional perspective views of alternative embodiments of containers 600 according to embodiments of the present invention.

Figure 7A:
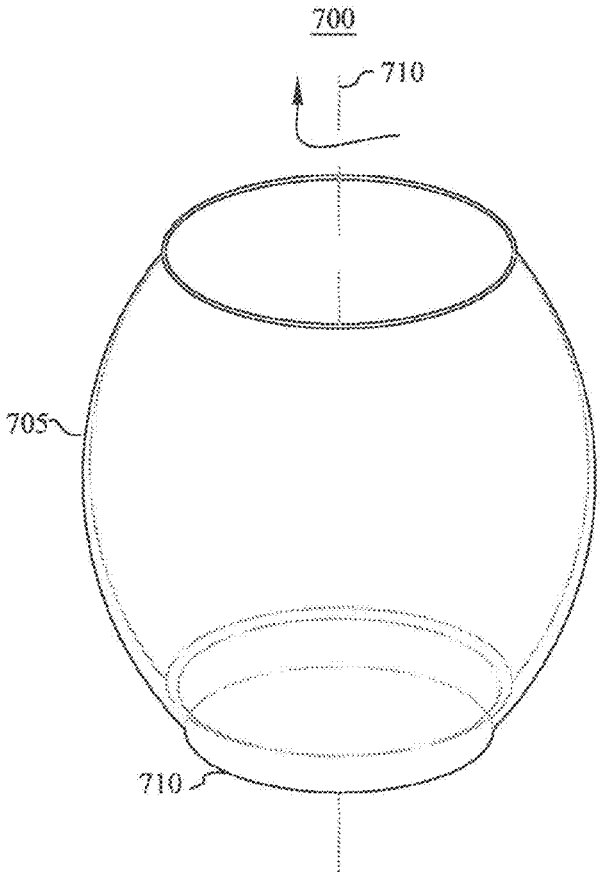
FIG. 7A depicts a perspective view of yet another alternative embodiment of a container according to embodiments of the present invention.
Figure 7B:
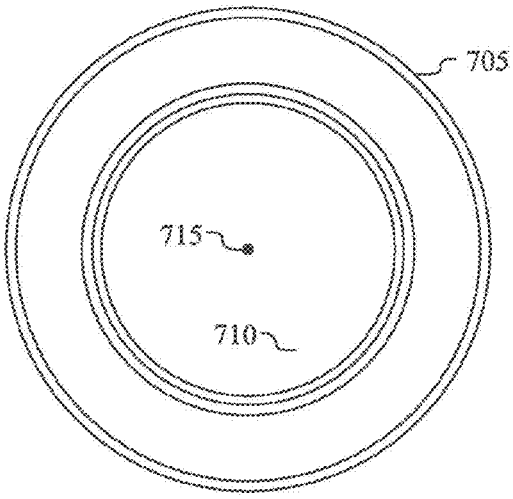
FIG. 7B depicts the base view of the container of FIG. 7A according to embodiments of the present invention.

Turning now to FIG. 7A, depicted is a perspective view of yet another alternative embodiment of a container according to embodiments of the present invention. FIG. 7B depicts the base view of the container of FIG. 7A according to embodiments of the present invention. As previously noted, the container may take numerous shapes and sizes provided the base comprises a central rotation point and one or more lateral features for stability. It shall be noted that the shape of a container may be suited for particular purposes. For example, the prior embodiments of FIG. 3A may be well suited for serving whiskey; whereas, the shape of the container in FIG. 7A may be better suited for serving wines.

As shown in FIGS. 7A and 7B, the container 700 comprises a central axis 715 about which it may rotate and a hollowed portion/container storage area 705 that sits above and is attached to a base 710.

Figure 8:
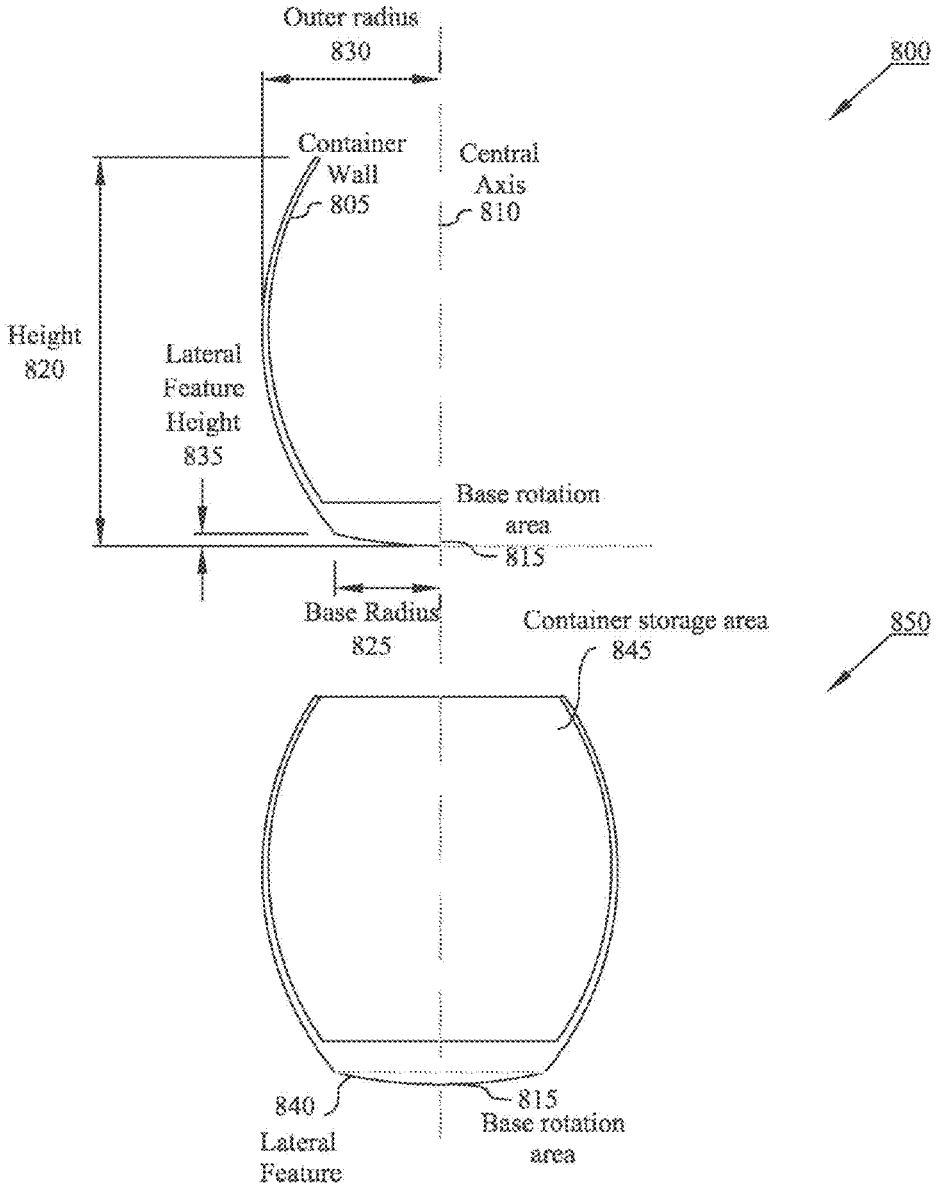
FIG. 8 depicts a section view and a side view of the container of FIG. 7A according to embodiments of the present invention.

FIG. 8 depicts a section view 800 and a side view 805 of the container of FIG. 7A according to embodiments of the present invention. As shown in FIG. 7, the lateral feature 840 comprises a slope feature that extends from the base rotation area 815 to the edge of the container and is slightly above the base rotation area 815. This height difference (i.e., the lateral feature height 835) allows the container to easily rotate about the central rotation point 815 but still provide stability from the lateral feature. In embodiments, the container may possess the same or similar ratios as previously described.

Figure 9A:
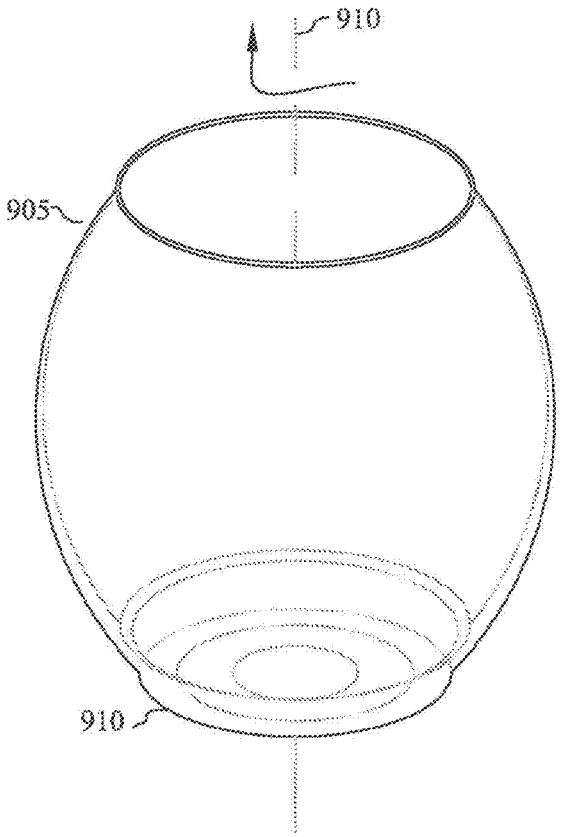
FIG. 9A depicts a perspective view of yet another alternative embodiment of a container according to embodiments of the present invention.
Figure 9B:
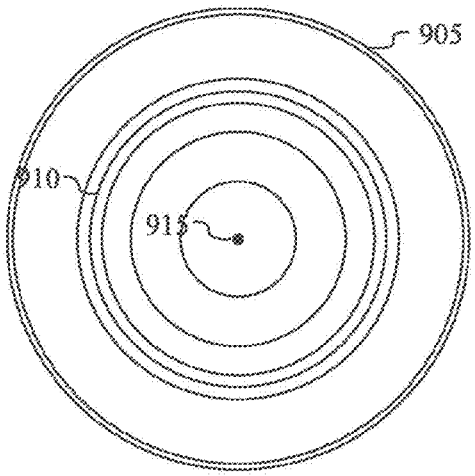
FIG. 9B depicts the base view of the container of FIG. 9A according to embodiments of the present invention.

FIG. 9A depicts a perspective view of yet another alternative embodiment of a container according to embodiments of the present invention, and FIG. 9B depicts the base view of the container of FIG. 9A according to embodiments of the present invention.

Figure 10:
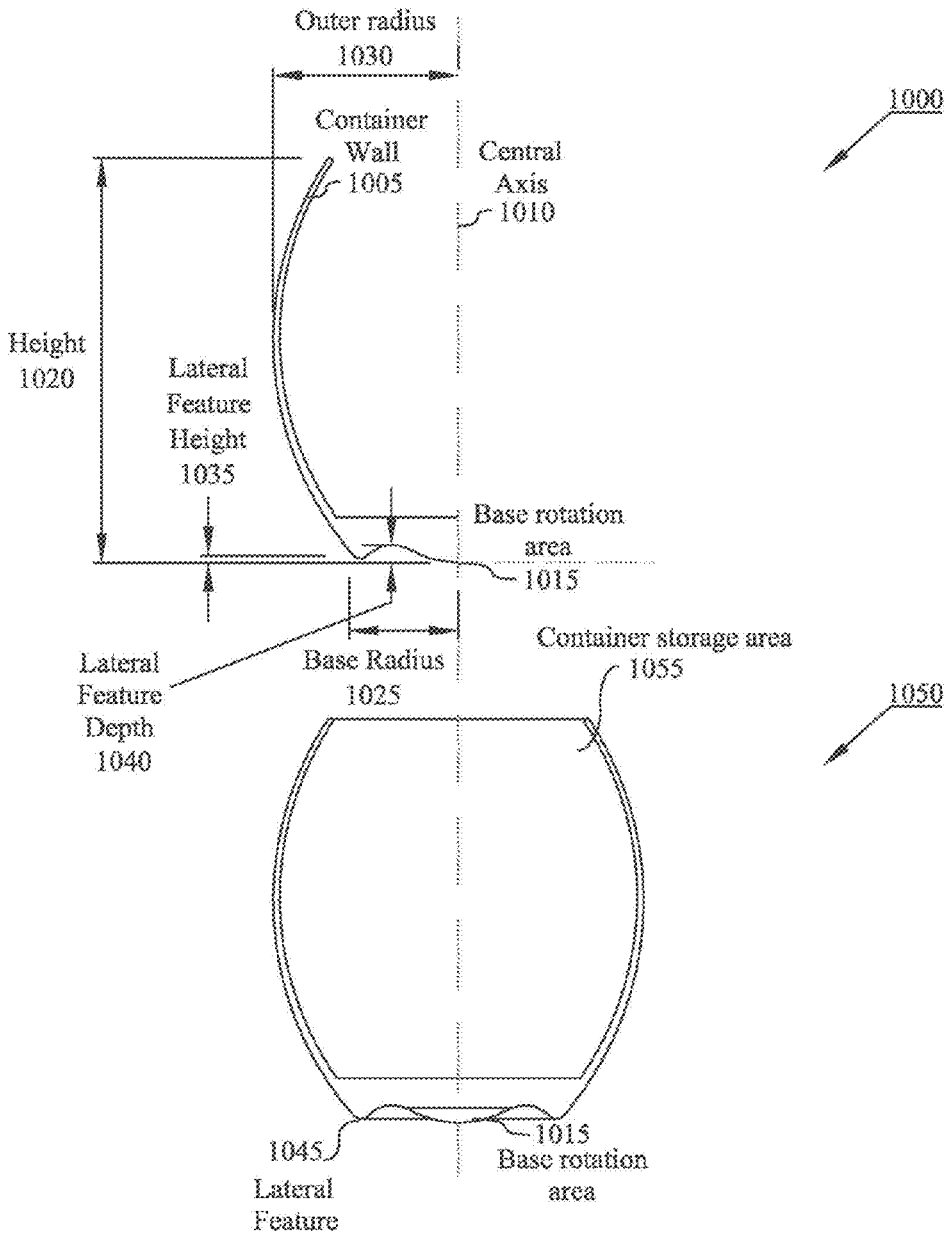
FIG. 10 depicts a section view and a side view of the container of FIG. 9A according to embodiments of the present invention.

FIG. 10 depicts a section view 1000 and a side view 1005 of the container of FIG. 9A according to embodiments of the present invention. As shown in FIG. 10, the lateral feature 1045 comprises a wave-like feature similar to that depicted and described above with respect to FIG. 4.

Figure 11:
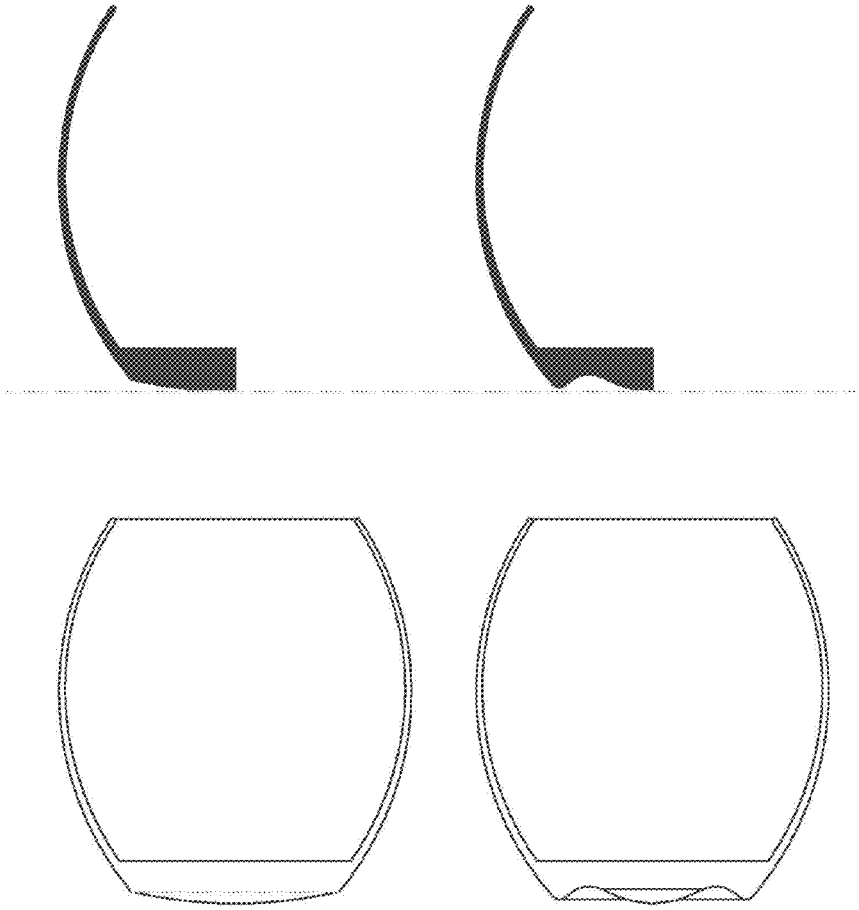
FIG. 11 depicts additional section views and side views of embodiments of containers according to embodiments of the present invention.

FIG. 11 depicts additional section views and side views of embodiments of containers 1100 according to embodiments of the present invention.

Figure 12:
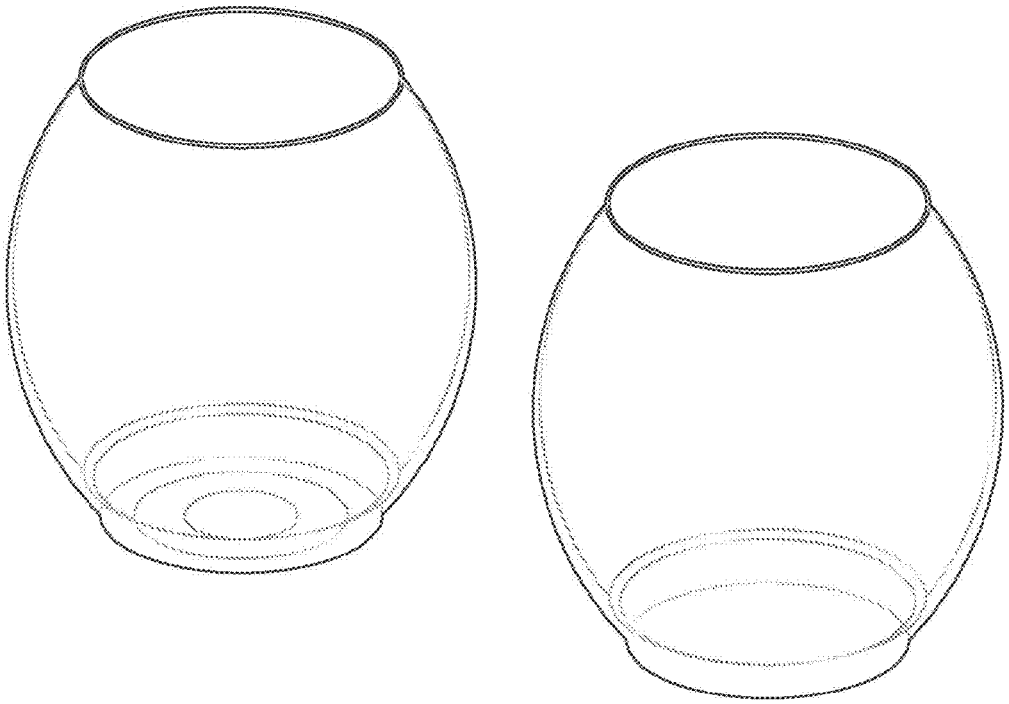
FIG. 12 depicts additional perspective views of alternative embodiments of containers according to embodiments of the present invention.

FIG. 12 depicts additional perspective views of alternative embodiments of containers 1200 according to embodiments of the present invention.

It shall be reiterated that the containers may take a variety of shapes and sizes, including that the base may vary from the container receptacle portion. Consider, for example, the embodiments shown in FIGS. 13A-16.

Figure 13B:
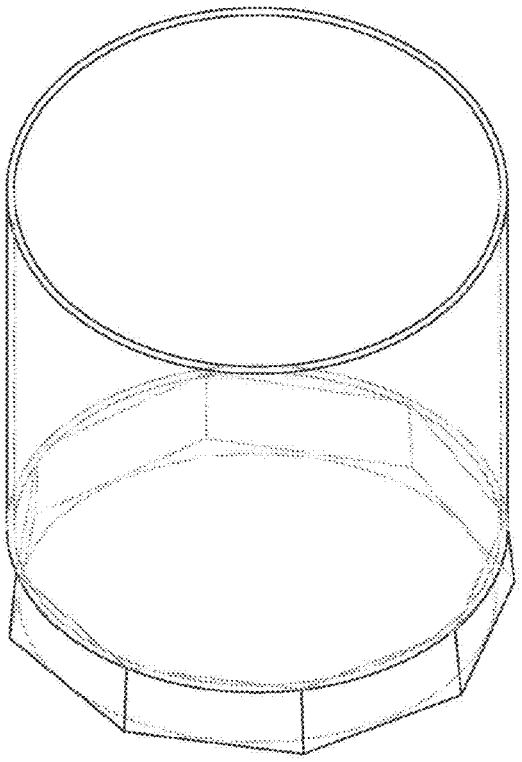
FIG. 13B depicts the base view of the octagonal-based container of FIG. 13A according to embodiments of the present invention.
Figure 13A:
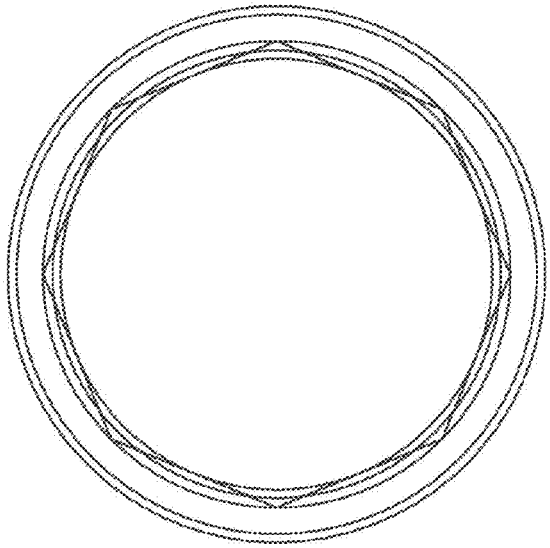
FIG. 13A depicts a perspective view of an octagonal-based container according to embodiments of the present invention.

FIG. 13A depicts a perspective view of an octagonal-based container 1300 according to embodiments of the present invention. FIG. 13B depicts the base view of the octagonal-based container of FIG. 13A according to embodiments of the present invention.

Figure 14:
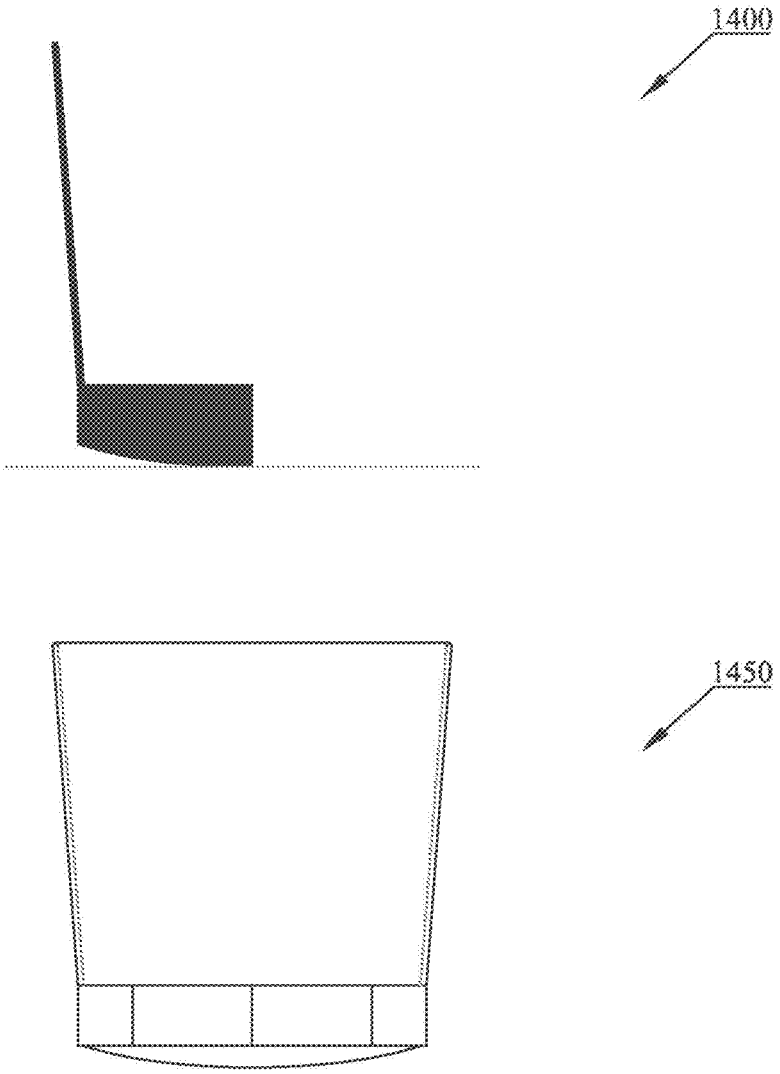
FIG. 14 depicts a section view and a side view of the octagonal-based container of FIG. 13A according to embodiments of the present invention.

FIG. 14 depicts a section view 1400 and a side view 1450 of the octagonal-based container of FIG. 13A according to embodiments of the present invention.

Figure 15:
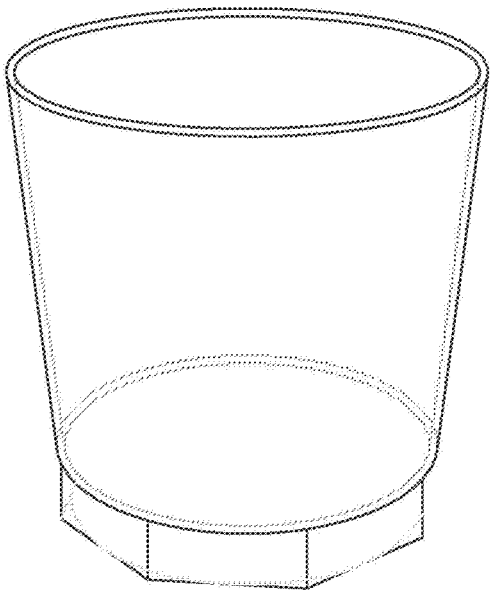
FIG. 15 depicts the octagonal-based container flared out according to embodiments of the present invention.

FIG. 15 depicts the octagonal-based container 1500 flared out according to embodiments of the present invention.

Figure 16:
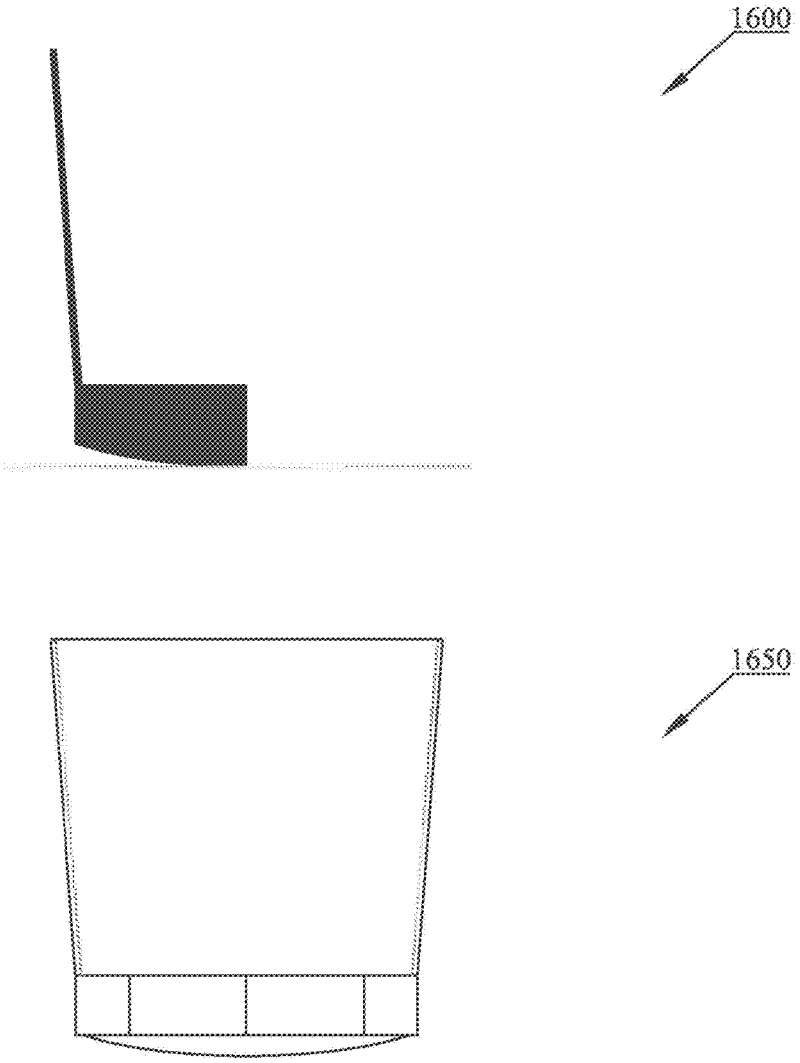
FIG. 16 depicts a section view and a side view of a pentagonal-based container according to embodiments of the present invention.

FIG. 16 depicts a section view 1600 and a side view 1650 of a pentagonal-based container according to embodiments of the present invention.

It shall also be noted that rotating the container may be done for a variety of purposes. The container may be spun to help aerate a beverage contained within the container. The container may be spun simply for amusement. And, the container may be incorporated into a game and spun as an indicator or random indicator generator. Consider, for example, the container 1700 depicted in FIG. 17.

Figure 17:
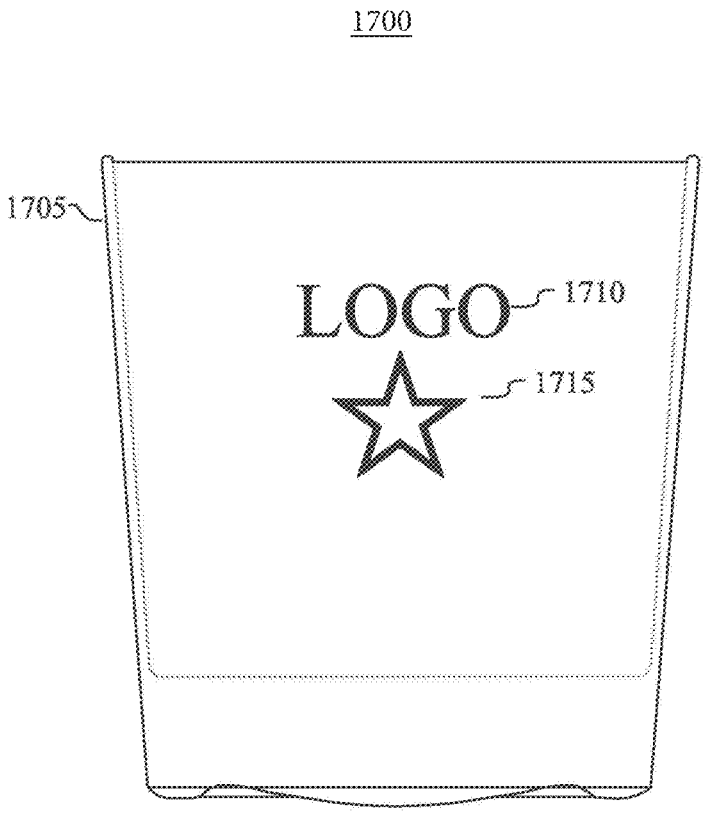
FIG. 17 depicts a side view of a container that includes at least one indicator according to embodiments of the present invention.

FIG. 17 depicts a side view of a container 1700 that includes at least one indicator according to embodiments of the present invention. In embodiments, the indicator may be one or more words, a logo 1710, a graphic 1715, or any combination thereof. Thus, the container may be a basis for a game, whereby having a marker or indicator (e.g., logo 1710 and/or graphic 1715) at any of the peripheries of the container may be used as an indicator. For example, after rotating, a person or object in front of the marker may indicate the next step or the next player of a game.

Figure 18:
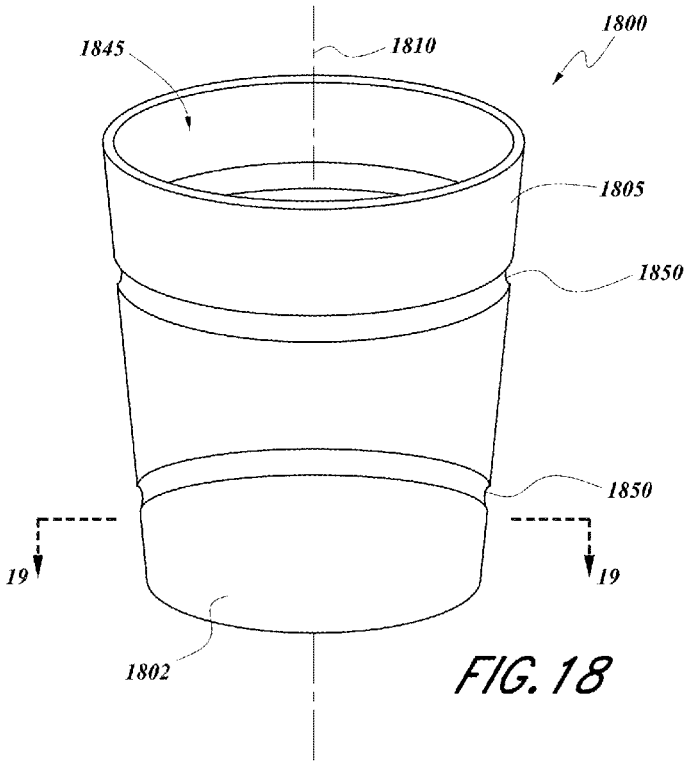
FIG. 18 depicts a perspective view of a container having at least one aeration feature.
Figure 19:
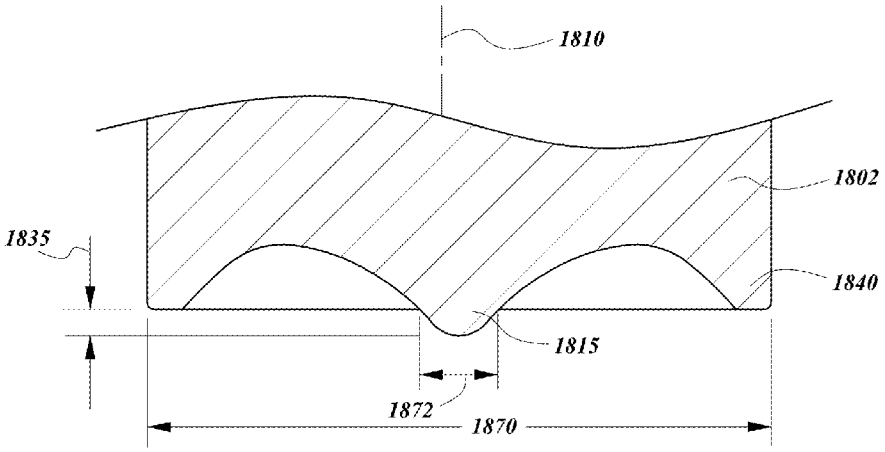
FIG. 19 depicts a sectional view of the container of FIG. 18 taken along line 19-19 of FIG. 18.

FIGS. 18 and 19 illustrate an additional embodiment of a container or glass 1800 that is configured to stably rotate about a central axis 1810. The container 1800 can be similar to other containers described herein. Accordingly, features not specifically described with respect to the container 1800 can be assumed to be the same as or similar to corresponding features from other containers described herein, or can be of another suitable arrangement. The container 1800 includes a base 1802 and a container wall 1805 that extends upwardly from the base 1802. The container wall 1805 is a hollow cylinder that defines a receptacle portion 1845 configured to receive a liquid or other contents. Unless otherwise noted, the term cylinder is used in a broad sense, which includes an extruded closed loop of any shape, such as circular or polygonal, for example. The container wall 1805 can taper along its length such that a cross-sectional dimension (e.g., diameter) of the container wall 1805 varies along its height.

The container 1800 preferably includes at least one feature 1850 in the container wall 1805. In the illustrated configuration, the feature 1850 is an aeration feature that facilitates aeration of the contents within the receptacle portion 1845 as a result of spinning the container 1800. However, in other embodiments, the feature 1850 can be purely decorative and, thus, may be located only on an outer surface of the container 1800. The illustrated feature 1850 comprises a band that extends uninterrupted in a circumferential direction of the container 1800. The illustrated band 1850 is an inward curve in the container wall 1805 that defines a concave curvature on an outer surface of the wall and a convex curvature on the inside/interior surface of the container wall 1805 that protrudes inwardly relative to adjacent portions of the container wall 1805. However, in other configurations, the band 1850 can be positioned on only one of the inner and outer surfaces of the container wall 1805.

A plane defined by the band 1850 is angled relative to an upper edge of the container 1800 and/or is non-perpendicular with respect to the central axis 1810. Thus, the band 1850 provides an appearance of vertical or wave-like movement during spinning of the container 1800, which can facilitate aeration of the liquid within the receptacle portion 1845. In the illustrated configuration, the container 1800 includes two aeration features 1850 that define planes that are angled relative to one another. In other configurations, the features 1850 could comprise interrupted bands or more complex shapes that do not define a flat plane. However, in some such configurations, an average plane of such a band can be angled relative to the upper edge of the container 1800 and/or non-perpendicular with respect to the central axis 1810. Because the illustrated bands 1850 extend in a circumferential direction of the container wall 1805, aeration can be facilitated while avoiding excess splashing of the liquid, which can occur with features that extend in a vertical direction or in alignment with the central axis 1810.

FIG. 19 illustrates an enlarged view of the base 1802, which can generally be similar to other containers described herein. However, the configuration of FIG. 19 is notable for the relatively small central axis feature 1815. The lateral feature 1840 extends uninterrupted about a circumference or perimeter of the base 1802 and is located at or adjacent an edge of the base 1802 to maintain the look of a conventional glass. The lateral feature 1840 can be configured to contact a flat surface upon which the container 1800 rests along a small surface area. Thus, the lateral feature 1840 can be relatively narrow in comparison to an overall diameter of the base 1802.

The lateral feature 1840 can define or approximately define an overall diameter 1870 of the base 1802. A bottom surface of the lateral feature 1840 can also define a plane that extends perpendicular to the central axis 1810. As described with respect to the other containers herein, the central axis feature 1815 extends below the lateral feature 1840 such that the container 1800 rests on the central axis feature 1815 when placed on a hard, flat surface. As described above, in some configurations, the central axis feature 1815 protrudes beyond the plane of the lateral feature 1840 by a lateral feature height or offset distance 1835 that can be about 0.05 mm to about 0.15 mm for a base diameter 1870 between about 20 mm to about 100 mm. A ratio of the radial distance to the lateral feature to the offset distance can be between about 200:1 and about 1000:1 taking into account manufacturing variations.

A portion of the central axis feature 1815 that intersects the plane of the lateral feature 1840 defines a projection cross-sectional dimension or projection diameter 1872 that can be a small portion of the overall base diameter 1870. In some configurations, the projection diameter 1872 can be between about 3 mm and about 5 mm and the base diameter 1870 can be between about 60 mm to about 100 mm, or about 70 mm to about 90 mm, or about 80 mm. In some configurations, a ratio of the base diameter 1870 to the projection diameter 1872 can be about 10:1 to about 40:1. Thus, an area defined by the intersection of the central axis feature 1815 and the plane of the lateral feature 1840 can be small relative to the area defined by the lateral feature 1840 or the area of the base 1802. In some configurations, the ratio between these areas can be about 1:200 to about 1:1000, about 1:400 to about 1:750, or about 1:500.

It shall also be noted that the container may have other functions or purposes as well. For example, the container may be a signification of an award, may be part of an art piece, and/or may be a display or an advertisement.

It will be appreciated to those skilled in the art that the preceding embodiments are exemplary and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention.

What is claimed is:

1. A glass configured for stable spinning, comprising:

a base;

a container wall extending upwardly from the base, the base and the container wall cooperating to define a central axis and a receptacle for receiving a liquid;

wherein a bottom surface of the base comprises:

a central axis feature positioned about a central axis of the glass;

a lateral feature positioned proximate an outer edge of the bottom surface of the base a radial distance from the central axis, the lateral feature encircling the base, wherein the central axis feature extends below a plane defined by the lateral feature by an offset distance such that the glass rests on the central axis feature when placed on a flat surface and the lateral feature contacts the flat surface when the glass is tilted;

wherein the offset distance is between 0.05 mm and 0.15 mm;

wherein a ratio of the radial distance to the lateral feature to the offset distance is between 200:1 and 1000:1.

2. The glass of claim 1, wherein an interior surface of the container wall comprises at least one aeration feature that extends in a circumferential direction of the container wall.

3. The glass of claim 2, wherein the at least one aeration feature comprises a first aeration feature and a second aeration feature.

4. The glass of claim 3, wherein a first plane defined by the first aeration feature is angled relative to a second plane defined by the second aeration feature.

5. The glass of claim 4, wherein both the first plane and the second plane are angled relative to an upper edge of the container wall.

6. The glass of claim 2, wherein the at least one aeration feature extends uninterrupted around the container wall.

7. The glass of claim 6, wherein the at least one aeration feature comprises a first aeration feature and a second aeration feature.

8. The glass of claim 7, wherein a first plane defined by the first aeration feature is angled relative to a second plane defined by the second aeration feature.

9. The glass of claim 8, wherein both the first plane and the second plane are angled relative to an upper edge of the container wall.

10. The glass of claim 1, wherein the base is circular in shape.

11. A glass configured for stable spinning, comprising:

a base;

a container wall extending upwardly from the base, the base and the container wall cooperating to define a central axis and a receptacle for receiving a liquid;

wherein a bottom surface of the base comprises:

a central axis feature positioned about a central axis of the glass;

a lateral feature positioned proximate an outer edge of the bottom surface of the base a radial distance from the central axis, the lateral feature encircling the base, wherein the central axis feature extends below a plane defined by the lateral feature by an offset distance such that the glass rests on the central axis feature when placed on a flat surface and the lateral feature contacts the flat surface when the glass is tilted;

wherein a portion of the central axis feature that intersects the plane of the lateral feature defines a projection diameter, wherein a ratio of a diameter of the lateral feature to the projection diameter is between 10:1 and 40:1.

12. The glass of claim 11, wherein an interior surface of the container wall comprises at least one aeration feature that extends in a circumferential direction of the container wall.

13. The glass of claim 12, wherein the at least one aeration feature comprises a first aeration feature and a second aeration feature.

14. The glass of claim 13, wherein a first plane defined by the first aeration feature is angled relative to a second plane defined by the second aeration feature.

15. The glass of claim 14, wherein both the first plane and the second plane are angled relative to an upper edge of the container wall.

16. The glass of claim 11, wherein the projection diameter is between 3 mm and 5 mm.

17. The glass of claim 11, wherein the base is circular in shape.

18. The glass of claim 11, wherein the base is polygonal in shape.

* * * * *